US007387709B2

(12) United States Patent
Bartelmuss et al.

(10) Patent No.: US 7,387,709 B2
(45) Date of Patent: Jun. 17, 2008

(54) HYDROFOIL FOR PAPERMAKING INSTALLATIONS

(76) Inventors: Klaus Bartelmuss, Teufenbach Nr. 63, Teufenbach (AT) A-8833; Heinz Bartelmuss, Teufenbach Nr. 63, Teufenbach (AT) A-8833

( * ) Notice: Subject to any disclaimer, the term of this patent is extended or adjusted under 35 U.S.C. 154(b) by 432 days.

(21) Appl. No.: 11/065,676

(22) Filed: Feb. 24, 2005

(65) Prior Publication Data

US 2005/0205227 A1 Sep. 22, 2005

(30) Foreign Application Priority Data

Mar. 17, 2004 (AT) ..... A 463/2004

(51) Int. Cl.
*D21F 1/52* (2006.01)
*D21G 9/00* (2006.01)

(52) U.S. Cl. ..... 162/352; 162/351; 162/374

(58) Field of Classification Search ..... 162/211, 162/217, 351, 352, 371, 374, 199, 354; 277/300
See application file for complete search history.

(56) References Cited

U.S. PATENT DOCUMENTS 3,446,702 A * 5/1969 Buchanan ..... 162/374
3,574,056 A * 4/1971 Jud ..... 162/352
3,870,597 A * 3/1975 Getman et al. ..... 162/352
3,928,125 A * 12/1975 Poeschl ..... 162/352
4,334,958 A * 6/1982 Baluha et al. ..... 162/352
4,449,565 A * 5/1984 Bartelmuss ..... 162/352
6,039,843 A * 3/2000 Wight ..... 162/352

FOREIGN PATENT DOCUMENTS

AT 372993 12/1983
DE 4319311 * 12/1994

OTHER PUBLICATIONS

DE 4319311 Dec. 1994 Goldmann et al. English translation of German document.*

* cited by examiner

*Primary Examiner*—Eric Hug
(74) *Attorney, Agent, or Firm*—Laurence A. Greenberg; Werner H. Stemer; Ralph E. Locher

(57) ABSTRACT

A hydrofoil for a papermaking installation has a supporting bar and plates of a ceramic material. Either the supporting bar or each ceramic plate fixed to the latter is formed on the mutually facing sides with at least one undercut groove extending in the direction of the supporting bar over the length of the plate, and the respective other part is formed with at least one retaining strip formed approximately oppositely to the undercut groove and extending in the direction of the supporting bar. The at least one retaining strip can be clamped in the at least one groove.

17 Claims, 5 Drawing Sheets

HYDROFOIL FOR PAPERMAKING INSTALLATIONS

BACKGROUND OF THE INVENTION

Field of the Invention

The present invention relates to a hydrofoil provided with plates of a ceramic material for papermaking installations.

Installations for papermaking have a wire, to the top side of which paper pulp is applied. The liquids contained in the paper stock pass through the wire and are stripped off by hydrofoils, over which the wire is led. Since, in this case, the hydrofoils are subjected to high mechanical loadings and since, furthermore, the liquids emerging from the paper stock are extremely aggressive, the hydrofoils must consist of very resistant materials. For this reason, hydrofoils are provided with plates of ceramic materials on the side facing the wire.

Plates consisting of ceramic materials, which are produced by powder sintering, can be produced only in lengths from about 10 cm to 20 cm, however. Since, by contrast, wires in papermaking installations have widths of more than 6 m, this means that the hydrofoils are constructed of a large number of ceramic plates which are arranged close beside one another and which are fixed to a supporting bar.

In order to fix the plates of ceramic material to the supporting bars, it is known to form both the supporting bars and the plates of ceramic material with recesses on the surfaces facing each other, into which connecting elements are inserted and are anchored in the recesses by means of plastic compounds. However, the use of plastic compounds for anchoring the connecting elements is disadvantageous, since the plastic compounds have substantially higher expansion coefficients as compared with the plates of ceramic material, which means that the plates of ceramic material are not fixed to the supporting bars with the necessary rigidities, because of thermal expansion, but instead can execute positional changes with respect to the supporting bars and with respect to one another. This applies in particular with regard to the mutual vertical positions of the individual plates of ceramic material. However, since the wire bears on the hydrofoils under high pressure, in the event that the surfaces of the hydrofoils are not completely flat, a number of disadvantageous effects occur. For example, in the regions of elevations of the hydrofoils, the wire is overloaded, which means that it is subjected to sharply increased wear.

Furthermore, in the regions located beside the elevations, the hydrofoils do not bear as closely on the wire, which means that their stripping action is reduced, for which reason the paper quality is different over the width of the wire.

SUMMARY OF THE INVENTION

It is accordingly an object of the invention to provide a hydrofoil for a paper-making installation which overcomes the above-mentioned disadvantages of the heretofore-known devices and methods of this general type and which avoids the problems associated with fixing the plates of a ceramic material to the supporting bar.

With the foregoing and other objects in view there is provided, in accordance with the invention, a hydrofoil for a papermaking plant, comprising:

a supporting bar and a plurality of plates of ceramic material mounted to the supporting bar;

one of the supporting bar and each the plates of ceramic material being formed, on mutually facing sides thereof, with at least one undercut groove extending in a direction of the supporting bar over a length of the plate, and, respectively, with at least one retaining strip formed substantially complementary to the undercut groove and extending in the direction of the supporting bar, and wherein the at least one retaining strip is configured to be clamped in the at least one groove.

In other words, the objects of the invention are achieved in that either the supporting bar or each ceramic plate fixed to the latter is formed on the mutually facing sides with at least one undercut groove extending in the direction of the supporting bar over the length of the plate or the hydrofoil, and the respective other part is formed with at least one retaining strip formed approximately oppositely to the undercut groove and extending in the direction of the supporting bar, and in that the at least one retaining strip is clamped in the at least one groove. In this way, the plates of a ceramic material can be fixed directly to the hydrofoils, by which means the disadvantages attached to the known prior art with regard to fixing are avoided.

The supporting bar is preferably formed with at least two parts which can be displaced with respect to one other, by means of whose displacement they can be clamped to the plates of a ceramic material. Here, the at least two parts of the supporting bar can be formed by two legs which can be displaced resiliently with respect to each other. Furthermore, the at least two parts of the supporting bar can be connected to one another in an articulated manner. In addition, the at least two parts of the supporting bar can be formed with mutually opposite profiling, by means of which they can be brought into contact with one another.

The at least two parts of the supporting bar which can be displaced with respect to one another are preferably assigned at least one setting device, by means of which they can be fixed in their position clamped to the plates of a ceramic material. In this case, the setting device can be formed by a compression screw, by a tension screw or by a pressure hose.

According to a preferred embodiment, each ceramic plate is formed with at least one groove and the supporting bar is formed with at least one retaining strip which can be inserted into this groove, the supporting bar being provided with two parts which can be displaced with respect to each other, which are formed with parts of the retaining strip and which, in that position wherein the at least one retaining strip is inserted into the grooves, can be spread with respect to each other. In this case, the at least two parts of the supporting bar that can be displaced with respect to one another and are in each case formed with parts of the retaining strip can be displaced away from one another by means of a setting screw, by which means the parts of the retaining strips projecting into the grooves can be clamped in the latter.

According to a further preferred embodiment, each ceramic plate is formed with at least one projecting retaining strip and the supporting bar is formed with at least one groove formed oppositely to the retaining strips, and the supporting bar is formed with at least two parts whose mutual spacing can be adjusted, it being possible for these two parts to be displaced with respect to each other and fixed in their position clamped to the retaining strips. In this case, too, the at least two parts of the supporting bar can be displaced with respect to one another by means of a setting device, in particular by means of a setting screw, and can be fixed in their position clamped to the ceramic plates.

According to a further preferred embodiment, the supporting bar is formed with a slot on its side facing the ceramic plates, which means that the at least two parts formed hereby can be displaced with respect to one another and fixed in their position clamped to the ceramic plates.

According to a further preferred embodiment, each ceramic plate is formed with at least one retaining strip and the supporting bar is formed with at least one groove formed oppositely to the at least one retaining strip, and the supporting bar is formed with at least two parts whose mutual spacing can be adjusted and which, in that position wherein these parts of the supporting bar are clamped to the at least one retaining strip, can be fixed by means of a filler material that can be introduced into the joint existing between these at least two parts of the supporting bar.

According to a further preferred embodiment, at least one locking element that is able to fix each ceramic plate and the supporting bar in their mutual position is inserted into the joint existing between the wall of the at least one groove and the at least one retaining strip. In this case, the locking element can be formed by a hose to which a pressure medium, in particular a hydraulic medium, can be applied. The locking element can also be formed by a self-contained hose containing a pressure medium, the volume of the pressure medium rising under the operating temperature.

Other features which are considered as characteristic for the invention are set forth in the appended claims.

Although the invention is illustrated and described herein as embodied in a hydrofoil for papermaking installations, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
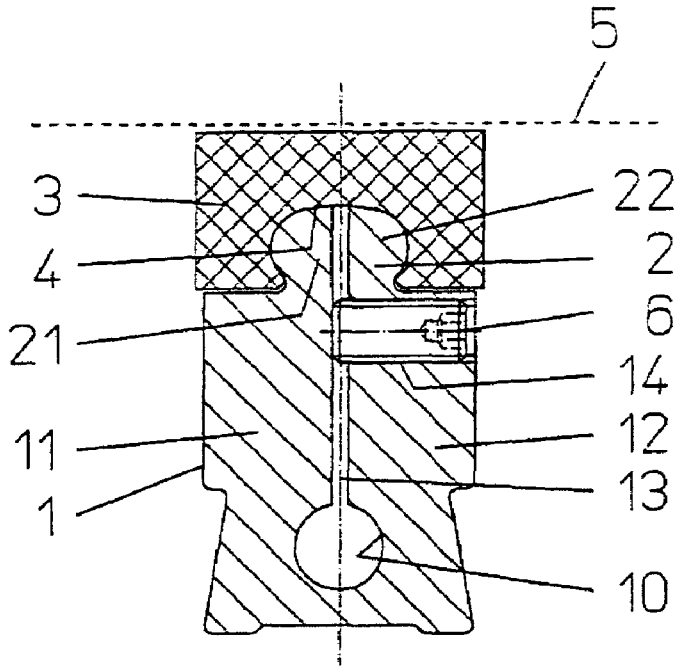
FIGS. 1 to 6 are cross-sectional views of six embodiments of a hydrofoil according to the invention.

Referring now to the figures of the drawing in detail and first, particularly, to FIG. 1 thereof, there is shown a hydrofoil—also referred to as a wiper strip, a wiper, a screen foil, or a scraper—according to the invention. The hydrofoil comprises a supporting bar 1 which, on the side facing a wire 5, is formed over its length corresponding to a width of the wire 5 with a large number of plates 3 of ceramic material adjoining one another. In order to fix the ceramic plates 3, on their side facing away from the wire 5, the plates 3 are formed with an undercut groove 4 which extends over their entire length, runs in the direction of the supporting bar 1, and into which a retaining strip 2 projecting from the supporting bar 1 projects. The cross section of the retaining strip 2 is formed approximately oppositely to the undercut groove 4 of the plates 3 of ceramic material.

In order to be able to insert the retaining strip 3 into the undercut groove 4, the supporting bar 1 is formed with two legs 11 and 12 which, on account of a continuous recess 10 provided in the supporting bar 1 and a slot 13 located between these two legs 11 and 12, can be displaced with respect to each other. Furthermore, from these two legs 11 and 12 there project two strips 21 and 22 which extend over the supporting bar 1, project into the groove 4 and form the retaining strip 2. In its spread position, the retaining strip 2 has a cross section opposite to that of the groove 4.

Since the two legs 11 and 12 can be displaced resiliently with respect to each other on account of the recess 10 and the slot 13 located between the latter, the two strips 21 and 22 can be inserted into the undercut grooves 4 of the plates 2 of a ceramic material. In order then to fix the plates 2 rigidly to the supporting bar 1, one of the two legs 11 and 12, the leg 12 in the present exemplary embodiment, is formed with a threaded hole 14, into which a setting screw 6 is inserted. As a result of rotation of the setting screw 6, the two legs 11 and 12 are spread apart, by which means the two strips 21 and 22 are clamped in the groove 4. In this way, the plates 2 are connected to the supporting bar 1 directly and with a form fit and in this way are fixed rigidly to the supporting bar 1.

Since the retaining strip 2 extends over the joints of the plates 3 of a ceramic material located beside one another, the plates 3 adjoining one another are aligned accurately with respect to one another and they are held accurately in their vertical position, as a result of which irregularities in their lateral position and any irregularities in their vertical position are avoided. Since, moreover, the fixing of the plate 3 to the supporting bar 1 is carried out by means of direct form-fitting locking of the supporting bar 1 to the plates 3 without the use of a plastic material, accurate and rigid fixing of the plates 3 to the supporting bar 1, meeting the requirements, is ensured.

For this purpose, it is critical that the plates 3 of a ceramic material be connected directly and with a form fit or form lock to the supporting bar 1.

The embodiment illustrated in FIG. 1 is additionally also advantageous since the fixing of the plates to the supporting bar 1 is detachable, which means that individual plates 3 which are damaged can be replaced.

Figure 2:
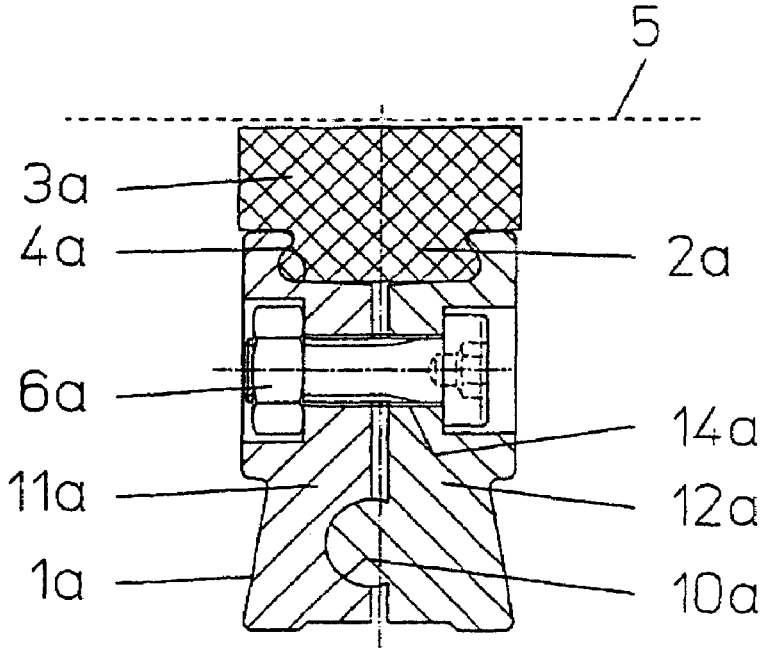

FIG. 2 illustrates an embodiment wherein the two legs 11*a* and 12*a* of the supporting bar 1*a* are connected to each other by means of a joint 10*a* such that they can be pivoted. This construction can also be provided in the embodiment according to FIG. 1. In addition, in the embodiment according to FIG. 2, the two legs 11*a* and 12*a* are formed with recesses on their side facing the plates 3*a*, by which an undercut groove 4*a* is formed, into which there projects a retaining strip 2*a* which projects from the plates 3 and which in cross section is opposite to the undercut groove 4*a*. In addition, the two legs 11*a*, 12*a* are penetrated in a hole 14*a* by a screw 6*a*, by which the two legs 11*a* and 12 can be displaced with respect to each other and can be fixed to each other, which means that the retaining strip 2*a* can be fixed rigidly in the groove 4*a*.

In this embodiment, too, there is direct fixing of the plates 3*a* of a ceramic material to the supporting bar 1*a*. Since this fixing is also detachable, individual plates 3*a* can be replaced simply.

Figure 3:
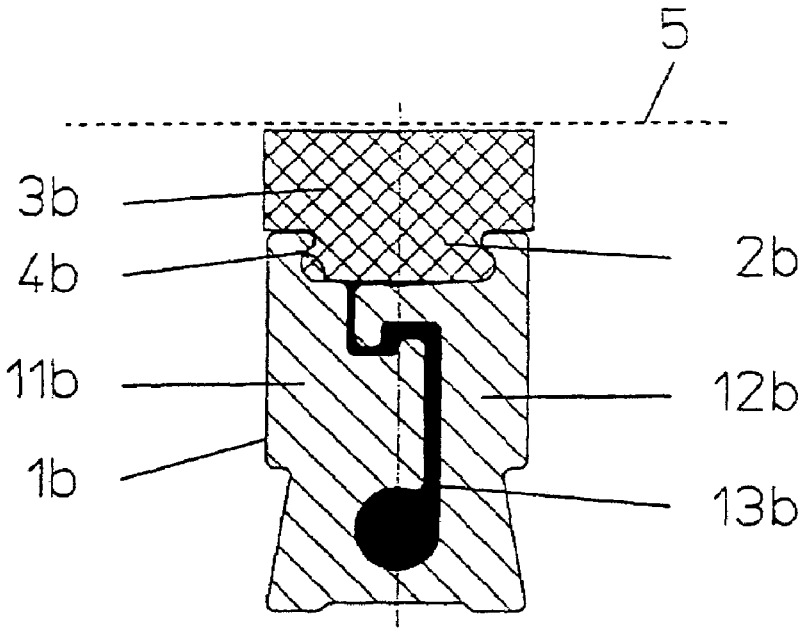

In the embodiment illustrated in FIG. 3, the supporting bar 1*b* is likewise formed with two mutually displaceable legs 11*b* and 12*b* which, on the side facing the plates 3*b* of a ceramic material, are formed in such a way that they form an undercut groove 4*b*, into which there projects a retaining strip 2*b* which projects from the plates 3*b* and whose cross section is formed oppositely to that of the groove 4*b*. The slot 13*b* located between the two legs 11*b* and 12*b* is of meandering form. As soon as the legs 11*b* and 12*b* have been pressed against each other, which means that they have been clamped to the retaining strip 2*b*, a filling compound, for example a plastic material, is introduced into the slot 13*b*, by which means the parts 11*b* and 12*b* located on each other are locked rigidly to each other. Since, in this case, the plates 3*b* are fixed directly to the supporting bar 1*b*, an accurate and rigid fixing which meets the requirements is also achieved hereby. In addition to this, it is pointed out that, in this embodiment as well, the plates can be formed with an undercut groove, into which there projects a two-part retaining strip which is provided on the two-part supporting bar and is formed oppositely to the groove, the retaining strip being locked in its position inserted into the groove and clamped by means of a plastic material introduced into the slot between the two legs of the supporting bar.

Figure 4:
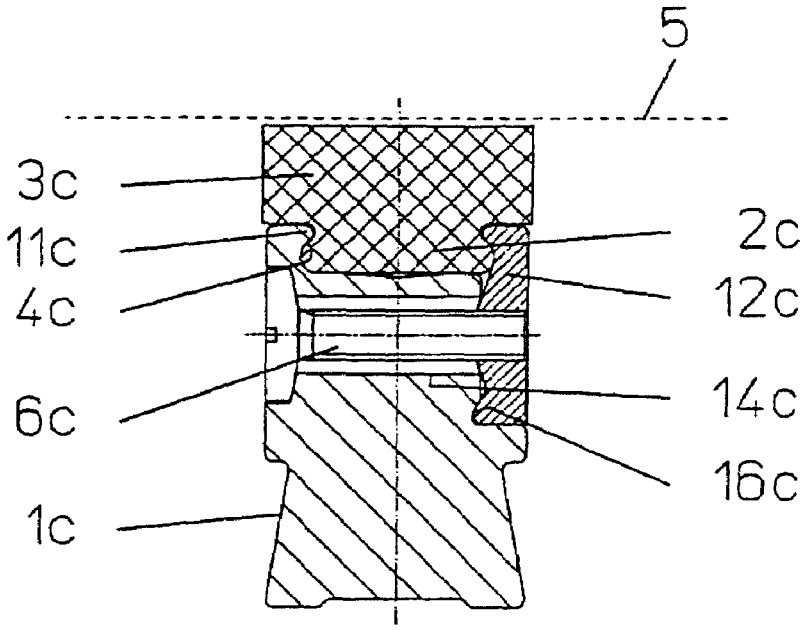

In the embodiment illustrated in FIG. 4, the plates 3*c* of a ceramic material are formed with a retaining strip 2*c* which projects into a groove 4*c* which is formed by a strip 11*c* provided on the supporting bar 1*c* and a fixing strip 12*c* forming a constituent part of the supporting bar 1*c*. The supporting bar 1*c* in this case is formed with an undercut groove 16*c*, into which the fixing strip 12*c* projects. In addition, the supporting bar 1*c* is formed with a hole 14*c*, into which a bolt 6*c* is inserted, which is screwed into the fixing strip 12*c*, by which means the latter can be clamped to the supporting bar 1*c* and the retaining strip 2*c*.

The plates 3*c* are fixed to the supporting bar 1*c* by the bolt 6*c* being screwed to the fixing strip 12*c*, the strip 11*c* and the fixing strip 12*c* engaging behind the retaining strip 2*c*. Thus, the retaining strip 2*c* projects into an undercut groove 4*c*, which is formed by the strip 11*c* projecting from the supporting bar 1*c* and the fixing strip 12*c* forming a constituent part of the supporting bar 1*c*.

In this embodiment, too, there is thus direct clamping of the supporting bar 1*c* to the plates 3*c* of a ceramic material. Since this fixing is also detachable, individual plates 3*c* can be replaced.

Figure 5:
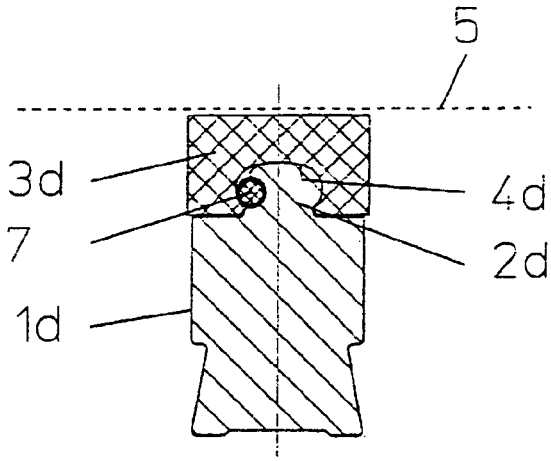

In the embodiment illustrated in FIG. 5, the supporting bar id formed in one piece is formed with a retaining strip 2*d* on its side facing the plates 3*d* of a ceramic material, said retaining strip 2*d* projecting into a groove 4*d* provided in the plates 3*d*, the action of clamping the plates 3*d* to the retaining strip 2*d* being carried out by a locking element 7, which is explained below by using FIGS. 7*a* and 7*b*.

Figure 6:
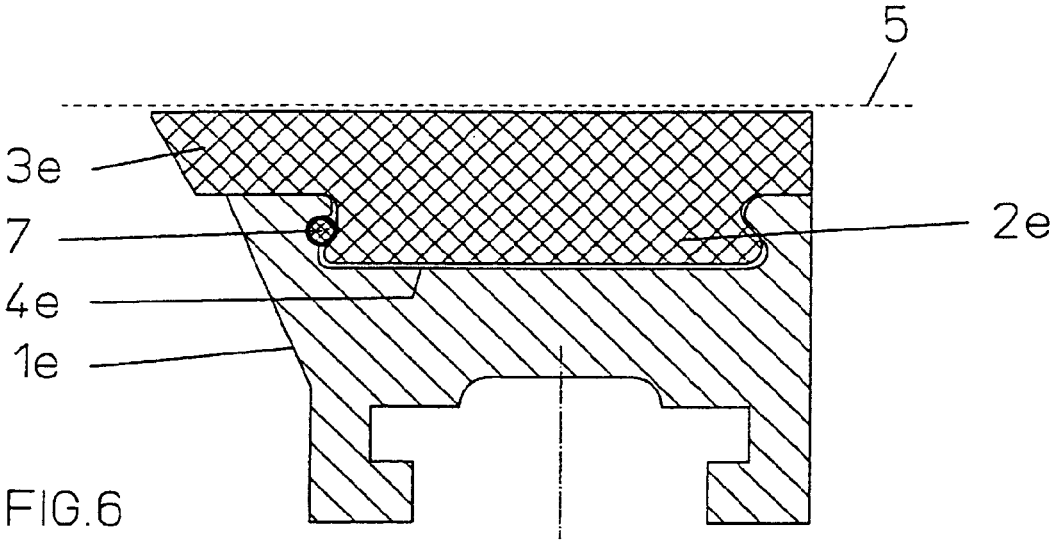

In the embodiment illustrated in FIG. 6, the supporting bar 1*e* is formed with an undercut groove 4*e*, into which there project retaining strips 2*e* consisting of the plates 3*e* of a ceramic material, the rigid fixing of the same to the supporting bar 1*e* likewise being carried out by means of a locking element 7 inserted into the joint located between the retaining strip 2*e* and the wall of the groove 4*e*.

Figure 6A:
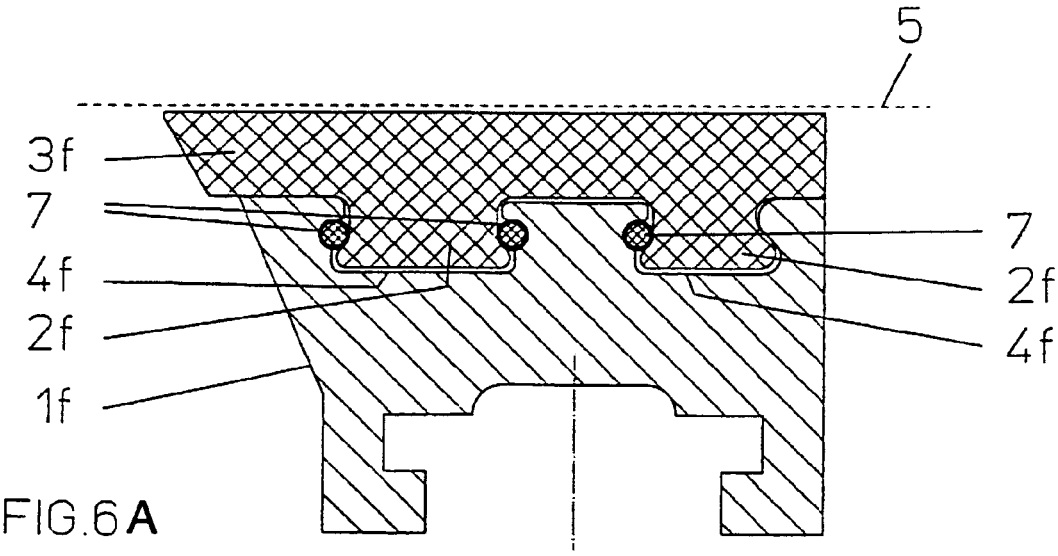
FIG. 6A is a cross-section showing a variant of the embodiment of a hydrofoil according to the invention according to FIG. 6.

As illustrated in FIG. 6A, moreover, the supporting bar 1*f* and the plates 3*f* of a ceramic material can be formed beside one another with a plurality of undercut grooves 4*f* and retaining strips 2*f* assigned to the latter, in each case a locking element 7 or a plurality of locking elements 7 being inserted into the joints located between the walls of the grooves 2*f* and the retaining strips 4*f*.

Figure 7:
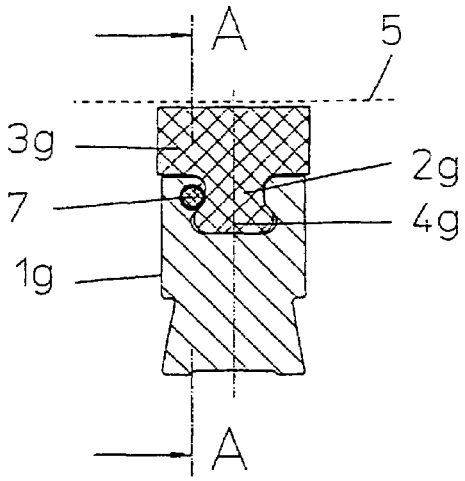
FIG. 7 is a cross-section showing a seventh embodiment of a hydrofoil according to the invention, in cross section.

FIG. 7 shows a supporting bar 1*g* which is formed with an undercut groove 4*g*, the plates 3*g* of a ceramic material being formed in each case with a retaining strip 2*g* projecting into the undercut groove 4*g* and the locking of the retaining strip 2*g* in the groove 4*g* being carried out by means of at least one locking element 7, which is inserted into the joint located between the walls of the groove 4*g* and the retaining strip 2*g*.

Figure 7A:
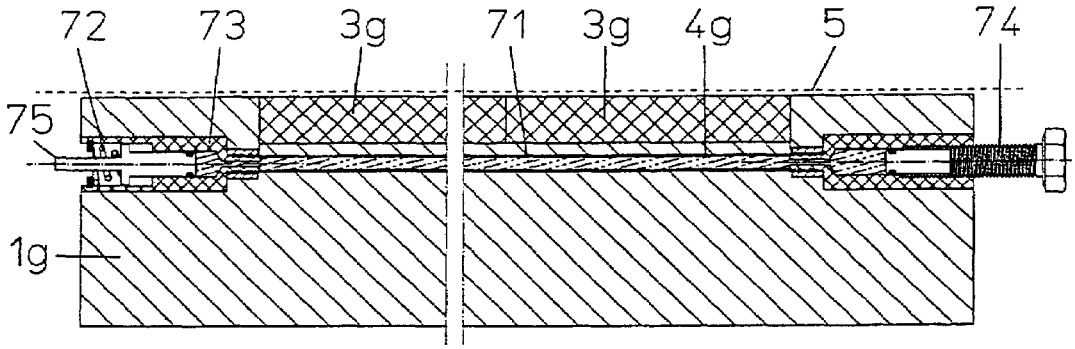
FIG. 7A is a section taken along the line A-A in FIG. 7 of the embodiment of the hydrofoil according to FIG. 7.

As can be seen from FIG. 7A, the locking element can be formed by a pressure hose 71, wherein there is a hydraulic medium and which, at one end, is formed with a closure 73 that is acted on by a compression spring 72 and, and the other end, is formed with a setting screw 74. By means of a pressure hose 71 of this type, rigid locking of the retaining strip 2*g* within the groove 4*g* is likewise effected, it being possible for this locking to be released at any time.

The pressure prevailing in the pressure hose is set by the setting screw 74. By means of the compression spring 72, there is regulation of the pressure in the event of pressure fluctuations caused by changes in the operating temperature, and also regulation in the event of the pressure decreasing as a result of leaks. Furthermore, an indication of the pressure prevailing in the pressure hose 71 is also carried out by means of a pin 75 projecting laterally from the closure 73.

Figure 7B:
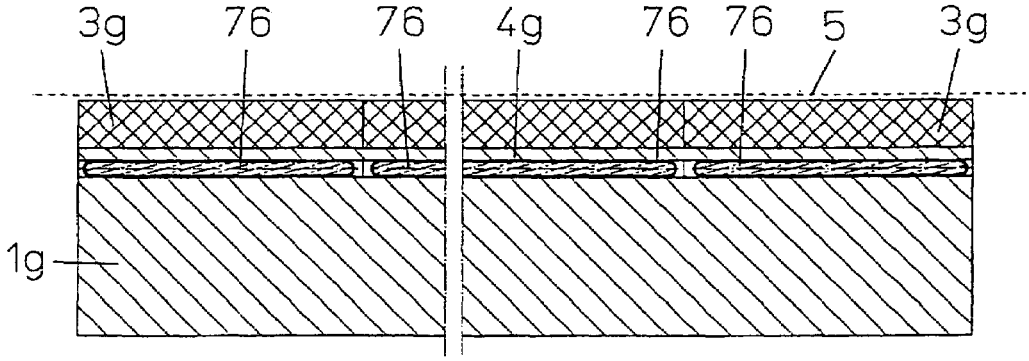
FIG. 7B is a variant of the embodiment, illustrated with the section taken along the line A-A in FIG. 7, of the hydrofoil according to FIG. 7.

In the embodiment illustrated in FIG. 7B, the locking element comprises a plurality of self-contained pressure hoses 76 which, in the highly cooled state, are inserted into the joint located between the wall of the undercut groove 4*g* and the retaining strip 2*g* and which, under the operating temperature, increase in cross section, as a result of which the intended locking of the retaining strips 2*g* within the undercut groove 4*g* is effected.

Figure 8:
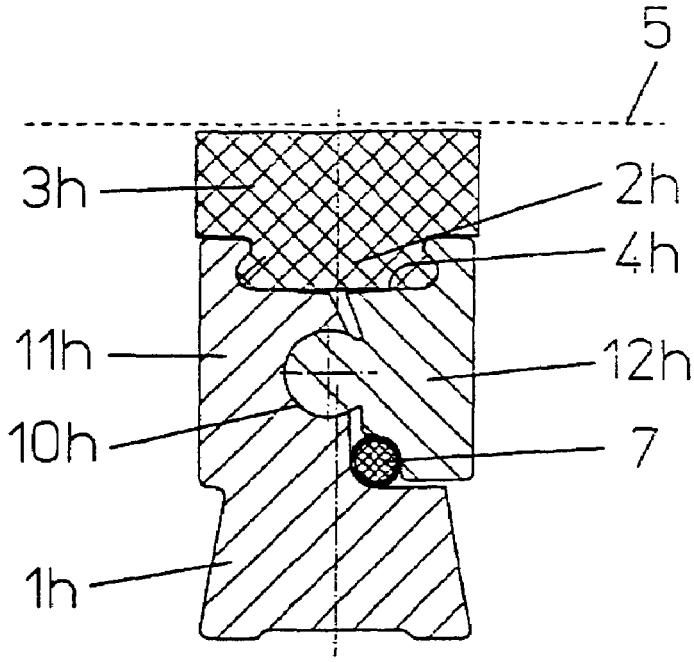
FIG. 8 is a cross-section showing an eighth embodiment of the hydrofoil according to the invention.

In the embodiment illustrated in FIG. 8, the supporting bar 1*h* is formed by a first leg 11*h* and by a second leg 12*h*, which are connected to each other by means of a joint 10*h* such that they can be pivoted with respect to each other. On the side facing the plates 3*h* of a ceramic material, these two legs 11*h* and 12*h* form a groove 4*h*, into which a retaining strip 2*h* projecting from the plates 3*h* projects. Moreover, between the two legs 11*h* and 12*h*, on the side facing away from the plates 3*h* in relation to the joint 10*h*, there is a locking element 7 of the type explained by using FIGS. 7*a* and 7*b*. By means of the locking element 7, the legs 11*h* and 12*h* can be pivoted with respect to each other and, as a result, clamped to the retaining strip 2*h*.

As an addition to this, it is pointed out that this embodiment can also be changed to the effect that the plates 3*h* is formed with a groove and the legs 11*h* and 12*h* of the supporting bar 1*h* are formed with a retaining strip projecting into this groove, the locking element 7 then having to be provided between the two legs 11*h* and 12*h* on the side facing the plates 3*h* in relation to the joint 10*h*.

Figure 8A:
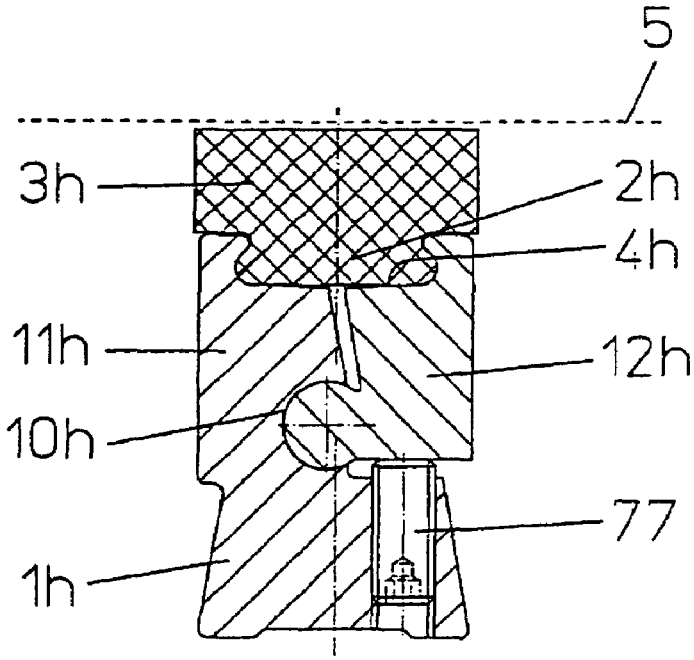
FIG. 8A is a cross-section showing a ninth embodiment of the hydrofoil according to the invention.

According to the design variant illustrated in FIG. 8A, instead of a pressure element in the form of at least one pressure hose, a compression screw 77 is provided, by means of which, via the joint 10*h*, the leg 12*h* can be pivoted with respect to the leg 11*h*, by which means the plates 3*h* can be clamped within the groove 4*h* formed by these legs 11*h* and 12*h*.

In an analogous way, in this case the plates 3*h* could also be formed with grooves and the legs 11*h* and 12 with parts of the retaining strip, it then being necessary for the two legs 11*h* and 12*h* to be adjusted away from each other by means of a setting screw passing through the leg 11*h*, in order to effect the intended locking of the supporting bar 1*h* to the plates 3*h* of a ceramic material.

For the hydrofoil according to the application, the following features are of critical importance:

The supporting bar and the plates of a ceramic material are in each case formed either with an undercut groove or with a retaining strip whose cross section is approximately opposite to that of the undercut groove, the retaining strip being inserted into the groove and locked in the latter by a form fit, which means that the supporting bar and the plates of a ceramic material can be fixed directly to one another. In this case, the supporting bar can also be formed in many parts.

This locking can be released in order to replace individual plates. Since the grooves and the retaining strips extend over the entire length of the hydrofoil, all the plates are aligned accurately with respect to the supporting bar and, moreover, are fixed in the same vertical position.

The supporting bars are produced from a plastic material reinforced by inlays of glass fibers, carbon fibers or the like, or extruded aluminum. The plates are produced from a ceramic material.

This application claims the priority, under 35 U.S.C. § 119, of Austrian patent application No. A 463/2004, filed Mar. 17, 2004; the entire disclosure of the prior application is herewith incorporated by reference.

We claim:

1. A hydrofoil for a papermaking plant, comprising:

a supporting bar formed with at least two parts displaceable disposed relative to one another and a plurality of plates of ceramic material mounted to said supporting bar;

one of said supporting bar and each said plates of ceramic material being formed, on mutually facing sides thereof, with at least two undercut grooves extending in a direction of said supporting bar over a length of said plate, and, respectively, with at least two retaining strips formed substantially complementary to said undercut grooves and extending in the direction of said supporting bar, and wherein said retaining strips are configured to be clamped in said grooves when said parts of said supporting bar are displaced relative to one another and said plates of ceramic material are clamped to said supporting bar.

2. The hydrofoil according to claim 1, wherein said at least two parts of said supporting bar are two legs resiliently displaceable with respect to one another.

3. The hydrofoil according to claim 1, wherein said at least two parts of said supporting bar are connected to one other in an articulated manner.

4. The hydrofoil according to claim 1, wherein said at least two parts of said supporting bar are formed with mutually complementary profiling to be brought into contact with one another.

5. The hydrofoil according to claim 1, which comprises at least one setting device for displacing said at least two parts with respect to one another and for clampingly fixing said supporting bar to said plates of ceramic material.

6. The hydrofoil according to claim 5, wherein said setting device is selected from the group consisting of a compression screw, a tension screw, and a pressure hose.

7. The hydrofoil according to claim 1, which comprises a setting screw for displacing said two parts of said supporting bar relative to one another and to thereby spreading and clamping said parts of said retaining strip in said grooves.

8. The hydrofoil according to claim 1, wherein said ceramic plates are each formed with at least one projecting retaining strip and said supporting bar has at least one groove formed therein opposite said retaining strips of said ceramic plates, and wherein said at least two parts are displaceable with respect to one another and fixable in a clamping position clamped to said retaining strips of said ceramic plates.

9. The hydrofoil according to claim 1, which comprises a setting device disposed to displace said at least two parts of said supporting bar relative to one another and to fix said two parts in a position clamped to said ceramic plates.

10. The hydrofoil according to claim 9, wherein said setting device is a setting screw.

11. The hydrofoil according to claim 2, wherein said supporting bar is formed with a slot on a side thereof facing said ceramic plates, and said at least two parts are displaceable relative to one another and fixable in a position clamped to said ceramic plates.

12. The hydrofoil according to claim 1, wherein each said ceramic plate is formed with at least one retaining strip and said supporting bar has at least one groove formed therein opposite said at least one retaining strip, said at least two parts of said supporting bar having an adjustable mutual spacing and a joint therebetween, and wherein said parts are clamped to said at least one retaining strip and fixed in the clamped position with a filler material introduced into said joint between said at least two parts of said supporting bar.

13. The hydrofoil according to claim 1, which comprises at least one locking element configured to fix each said ceramic plate and said supporting bar in a mutual position thereof, said locking element being inserted into a joint existing between a wall of a groove formed in said supporting bar and said retaining strip.

14. The hydrofoil according to claim 13, wherein said locking element is a hose connected to be filled with a pressure medium.

15. The hydrofoil according to claim 14, wherein said pressure medium is a hydraulic medium.

16. The hydrofoil according to claim 13, wherein said locking element is a self-contained hose containing a pressure medium, and wherein a volume of said pressure medium rises proportionally to an operating temperature.

17. A hydrofoil for a papermaking plant, comprising:

a supporting bar and a plurality of plates of ceramic material mounted to said supporting bar;

said supporting bar and each of said plates of ceramic material being formed with at least one undercut groove extending in a direction of said supporting bar over a length of said plate; and a fixing strip formed with at least two retaining strips substantially complementary to said undercut grooves in said supporting bar and said plate of ceramic material, respectively, and configured to clamp said plates of ceramic material to said supporting bar with said retaining strip meshing with said grooves in said supporting bar and said plate of ceramic material.

* * * * *